US005711115A

United States Patent [19]

Wirt

[11] Patent Number: 5,711,115

[45] Date of Patent: Jan. 27, 1998

[54] FIREPLACE SHELF AND MANTEL SUPPORT SYSTEM

[75] Inventor: Nanci Marie Wirt, Elkhart, Ind.

[73] Assignee: Design Components, Inc., Elkhart, Ind.

[21] Appl. No.: 739,260

[22] Filed: Oct. 30, 1996

[51] Int. Cl.[6] ..... F24B 1/198

[52] U.S. Cl. ..... 52/36.3; 52/36.4; 52/36.5

[58] Field of Search ..... 52/36.3, 36.4, 52/36.5; 211/90, 94, 153

[56] References Cited

U.S. PATENT DOCUMENTS

| | | | |
|---|---|---|---|
| 1,164,024 | 12/1915 | Smith et al. | 52/36.3 X |
| 3,184,068 | 5/1965 | Wende . | |
| 4,401,222 | 8/1983 | Kulikowski et al. . | |
| 4,550,893 | 11/1985 | Wiersema et al. . | |
| 4,615,448 | 10/1986 | Johnstonbaugh . | |
| 4,944,416 | 7/1990 | Peterson et al. | 52/36.5 |
| 4,958,594 | 9/1990 | Swagerty . | |
| 5,138,803 | 8/1992 | Grossen . | |
| 5,185,971 | 2/1993 | Johnson, Jr. . | |
| 5,201,191 | 4/1993 | Bustos . | |
| 5,242,048 | 9/1993 | Ellingsworth et al. . | |
| 5,337,903 | 8/1994 | Wolcovitch et al. . | |

*Primary Examiner*—Christopher Kent
*Attorney, Agent, or Firm*—George Pappas

[57] ABSTRACT

A fireplace shelf and mantel support system includes slotwall panels affixed to the structure wall above and to the side of the fireplace opening. The slotwall panels include T-shaped support slots. A mantel and shelves are provided and are supported on the slotwall panels with support brackets. The support brackets include a leg having an inturned upper portion extending into the slotwall support slots and an arm extending away therefrom for supporting the mantel or shelves. Edge trim is provided along the perimeter edge of the slotwall panels.

20 Claims, 3 Drawing Sheets

FIREPLACE SHELF AND MANTEL SUPPORT SYSTEM

TECHNICAL FIELD

The present invention relates to the field of fireplace construction and, more particularly, to an efficient and relatively inexpensive assembly system of a mantel and shelves around and adjacent a fireplace opening.

BACKGROUND OF THE INVENTION

Fireplaces are very commonly installed and used in structures such as commercial buildings, homes, mobile homes, trailers, etc. The fireplaces are generally located behind a wall of the structure and a fireplace opening extends through the wall to the fireplace hearth. The hearth is connected to a chimney in a known and customary manner for the escape of smoke and flue gases.

It is customary to affix and/or otherwise provide a mantel or a mantel/shelf on the structure wall generally over the fireplace opening. It is sometimes also desirable to provide additional shelving and/or bookcases around the fireplace opening for supporting and displaying for example, photographs, books, knickknacks, etc. Unfortunately the cost of materials and construction for the assembly of a fireplace mantel and shelves therearound can sometimes be relatively high. Additionally, because most mantels are permanently affixed to the structure wall, the completed assembly does not provide any flexibility should the consumer desire to relocate the mantel at a higher or lower location and/or to remove the mantel all together. Accordingly, a need exists for a fireplace shelf and mantel support system which is aesthetically pleasing and versatile and, further, wherein the cost of the materials and construction is relatively low.

SUMMARY OF THE INVENTION

It is the principal object of the present invention to overcome the above-discussed disadvantages associated with prior fireplace mantel and shelves constructions.

The present invention overcomes the disadvantages associated with prior fireplace mantel and shelves assemblies by providing a fireplace mantel and shelf support system including at least one slotwall panel having a plurality of bracket support slots. The slotwall panel is attached to the structure wall adjacent the fireplace opening and is located at least above the upper horizontal peripheral edge of the fireplace opening. The slotwall panel bracket support slots are generally T-shaped in cross-section. One or more support brackets are provided and cooperate with the T-shaped slots by partially extending into a bracket support slot and away from the slotwall panel thereby supporting the mantel or shelves. Preferably, the support bracket includes a leg having an inturned hook portion which is received in the T-shaped bracket support slot and, further, includes a support arm which is affixed to and extends away from the bracket leg. The mantel and/or other shelves are supported on the support bracket arm.

In the preferred embodiment, one or more shelves are provided and are supported by similar support brackets either on the slotwall panel located above the upper horizontal peripheral edge of the fireplace opening or to the left and/or right of the fireplace opening. With respect to the shelves on the left and right of the fireplace opening, slotwall panels having a plurality of bracket support slots are attached to the structure wall to the left and/or right of the vertical peripheral edges of the fireplace opening. Thus, one or more additional shelves can be provided to the left and/or right of the fireplace opening and supported by similar support brackets. As can be appreciated, the mantel and/or the additional shelves are easily removable and can be easily re-attached to the slotwall panels in anyone of the different plurality of bracket support slots and in one of many different positions as may be desired.

In the preferred embodiment, edge trim is also provided and extends along the peripheral edge of the slotwall panel or panels. Preferably, the edge trim is L-shaped in cross-section so as to properly cover the slotwall panel peripheral edges and be aesthetically pleasing.

In one form thereof, the present invention is directed to a fireplace shelf and mantel support system including a fireplace opening extending through a wall. A slotwall panel is provided having a plurality of bracket support slots. The slotwall panel is attached to the wall adjacent the fireplace opening. A mantel is supported on the slotwall panel with a support bracket which at least partially extends into one of a bracket support slots and away from the slotwall panel.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DESCRIPTION OF THE PREFERRED EMBODIMENTS

Figure 1:
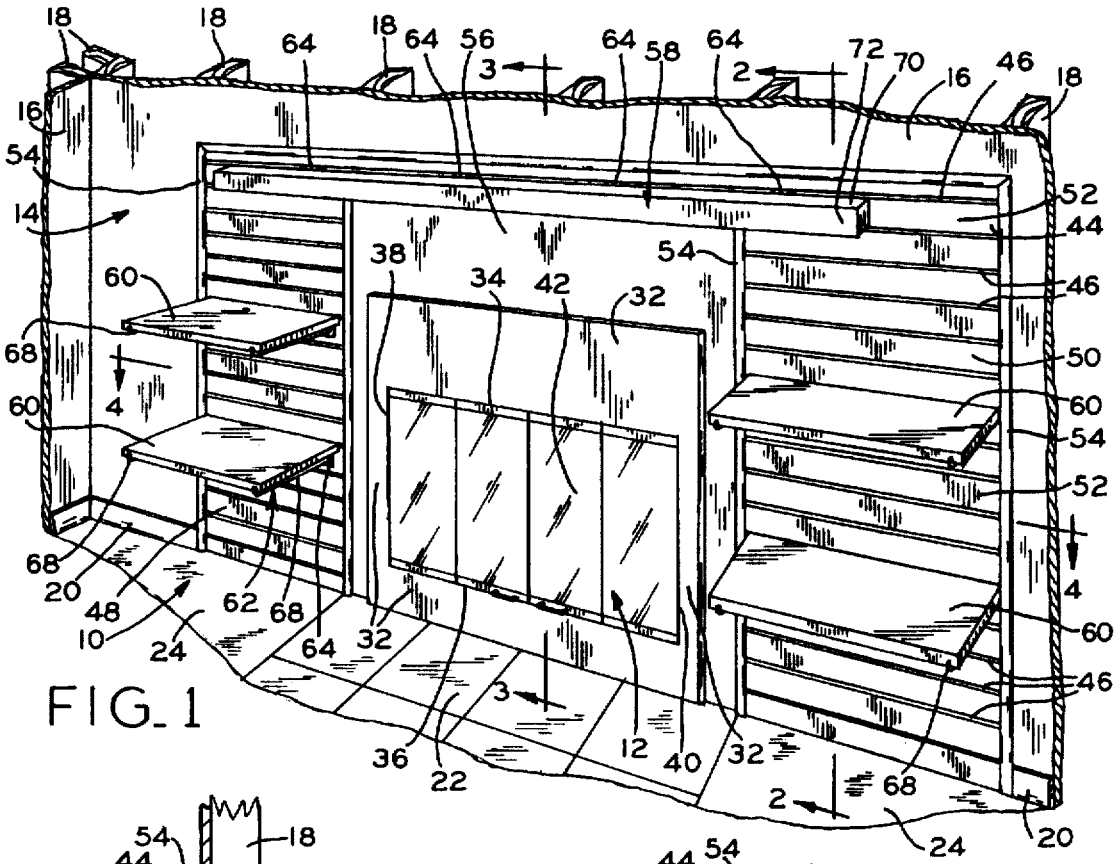
FIG. 1 is a perspective view of a fireplace shelf and mantel support system constructed in accordance with the principles of the present invention.

Referring initially to FIG. 1, the fireplace shelf and mantel support system is shown and generally designated by the numeral 10. In particular, a fireplace opening 12 extends through a wall 14 of a structure such as a commercial building, a house, mobile home, trailer, etc. Wall 14 is preferably and typically made of a drywall layer 16, which is commonly available and used in constructing such structures. Drywall 16 is attached to a framing structure made of, for example, 2×4 inch wood members which are also commonly available and used in construction of such structures. Base trim 20 is typically used along the lower perimeter edge of drywall 16. In front of the fireplace opening 12, there is provided a fire resistant layer 22 made, for example, of tile or brick. Carpeting and/or other floor covering materials 24 are used in front of the wall 14 and to the left and right of fireplace opening 12 and the fire resistant layer 22.

Figure 2:
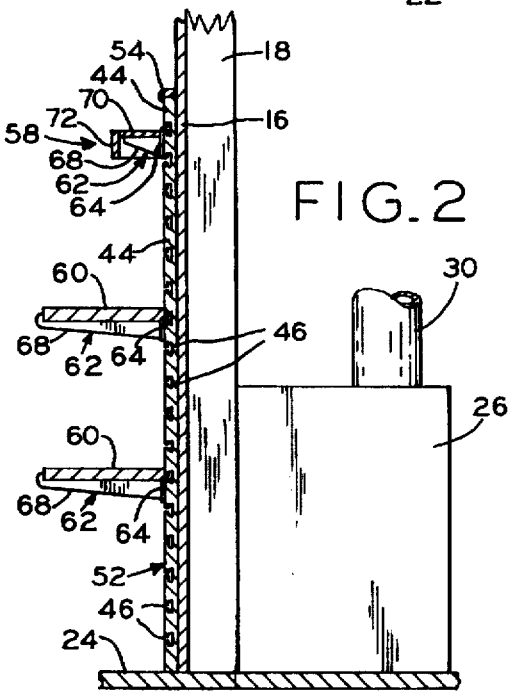
FIG. 2 is a cross-sectional view of the fireplace shelf and mantel support system shown in FIG. 1 taken along line 2—2.
Figure 3:
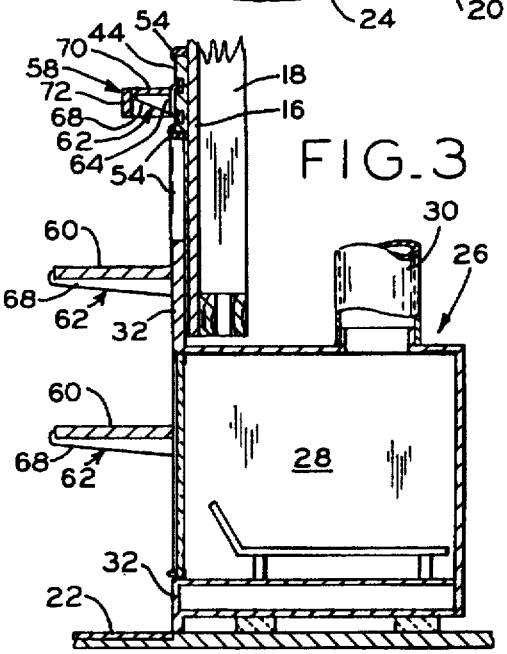
FIG. 3 is a cross-sectional view of the fireplace shelf and mantel support system shown in FIG. 1 taken along line 3—3.
Figure 4:
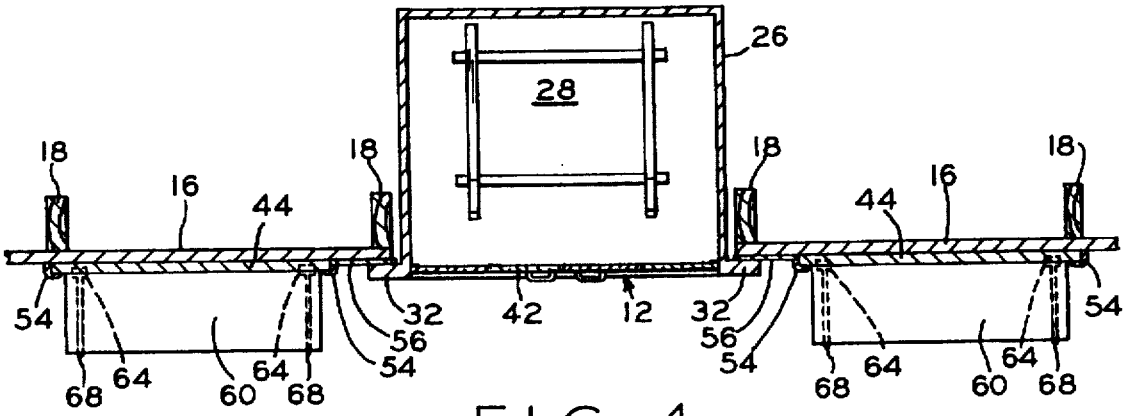
FIG. 4 is a cross-sectional view of the fireplace shelf and mantel support system shown in FIG. 1 taken along line 4—4.

A fireplace insert 26 is quite often provided as shown in FIGS. 2 and 3 although a masonry fireplace could be used as well. Nevertheless, a fireplace opening 12 leads into the combustion chamber 28 of either the fireplace insert 26 or a masonry fireplace combustion chamber (not shown) in a known and customary manner. Wood and other combustible materials are placed within the combustion chamber 28 and the smoke and flue gases thereof, are exhausted through the chimney or exhaust pipe 30.

The fireplace insert 26 includes a front face lip 32 surrounding the fireplace opening 12 and fitting snugly against the drywall layer 16. Thus, the fireplace opening in the preferred embodiment shown in FIG. 1 is defined by an upper horizontal peripheral edge 34, a lower horizontal peripheral edge 36, a left vertical peripheral edge 38 and right vertical peripheral edge 40. A set of glass doors 42 are provided for selectively closing and opening the fireplace opening 12.

Figure 6:
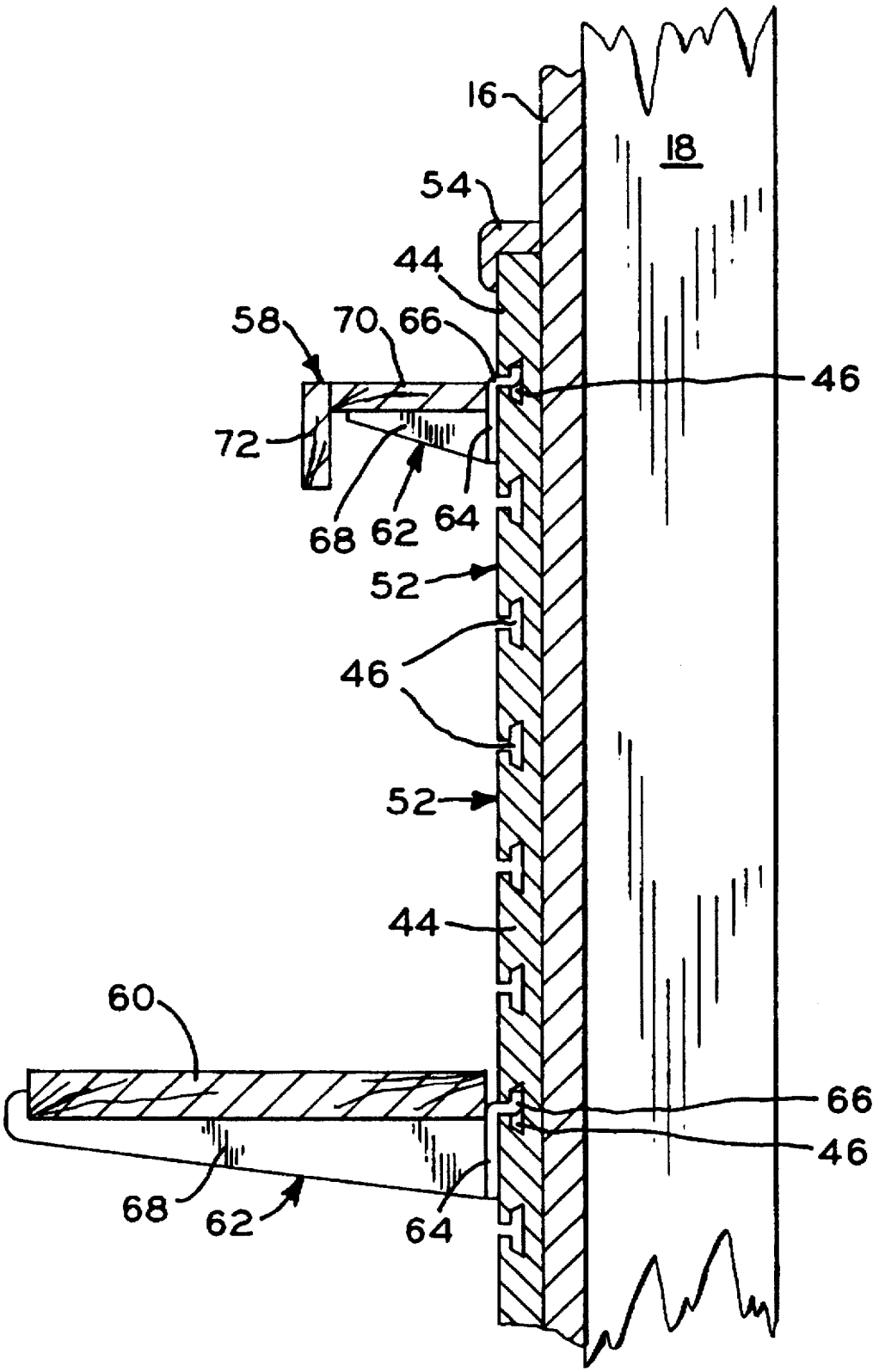

Referring now particularly to FIGS. 1–4 and 6, the fireplace shelf and mantel support system includes an upper slotwall panel 44 extending horizontally and to the left and right of the fireplace opening 12. Slotwall panel 44 is commercially available from various different sources and is typically made of ¾ inch thick particle board. Slotwall panel 44 includes at least one bracket support slot 46 which, as best shown in FIGS. 2, 3 and 6, is T-shaped in cross-section. Slotwall panel 44 is attached to the drywall 16 and 2×4 wood framing 18 with fasteners such as screws (not shown) and/or in other customary manners.

To the left of fireplace opening 12 and directly below upper slotwall panel 44, the left slotwall panel 48 is provided and is also affixed to the drywall 16 and 2×4 framing 18. Similar to the right of fireplace opening 12 and directly below upper slotwall panel 44, the right slotwall panel 50 is provided and is affixed to the drywall 16 and 2×4 framing 18 with fasteners such as screws (not shown). Left slotwall panel 48 and right slotwall panel 50, like the upper slotwall panel 44, are also made of particle-board type material and include a plurality of T-shaped bracket support slots 46 as shown. It is noted that the upper or showing surface 52 of slotwall panels 44, 48 and 50 can be made of different materials and/or can be painted thereby providing different colors and appearances as may be needed or desired.

Edge trim 54 which is preferably L-shaped in cross-section is provided along the outer perimeter edges of slotwall panels 44, 48 and 50 so as to cover the sharp edges thereof and provide an aesthetically pleasing appearance. Edge trim 54 can be made of wood or other molded materials with an outer surface or finish so as to match and be aesthetically pleasing with respect to the upper or showing surface 52 of the slotwall panels. Further, a fire resistant layer 56 is affixed to the drywall 16 between the fireplace opening 12 and the slotwall panels 44, 48 and 50. Fire resistant layer 56 is made of one or more fire resistant materials and is both fire resistant and has a surface finish which is aesthetically pleasing.

The fireplace shelf and mantel support system 10 further includes a mantel or mantel shelf 58 and one or more shelves 60. Mantel 58 and shelves 60 are supported on the slotwall panels 44, 48, and 50 through the use of support brackets generally designated by the numeral 62. Support brackets 62 each include a leg 64 having an inturned hook portion 66 at their upper end and a generally flat portion at their lower end. The bracket leg inturned hook portions 66 are selectively received within the T-shaped bracket support slots 46 as best seen in FIG. 6. The lower portion of bracket legs 64 extends over and lays against the upper surface 52 of the slotwall panels. Support brackets 62, each further include a support arm 68 affixed to the bracket leg 64 thereof and extending away therefrom generally perpendicularly. As can be appreciated, the inturned hook portion 66 of support bracket 62 are easily removable and placed within anyone of the bracket support slots 46 for supporting the mantel 58 or shelves 60. As best seen in FIGS. 2, 3 and 6, mantel 58 includes a shelf portion 70 and an apron 72 extending downwardly therefrom and essentially hiding from plain view the support brackets 62 thereunder.

Figure 5:
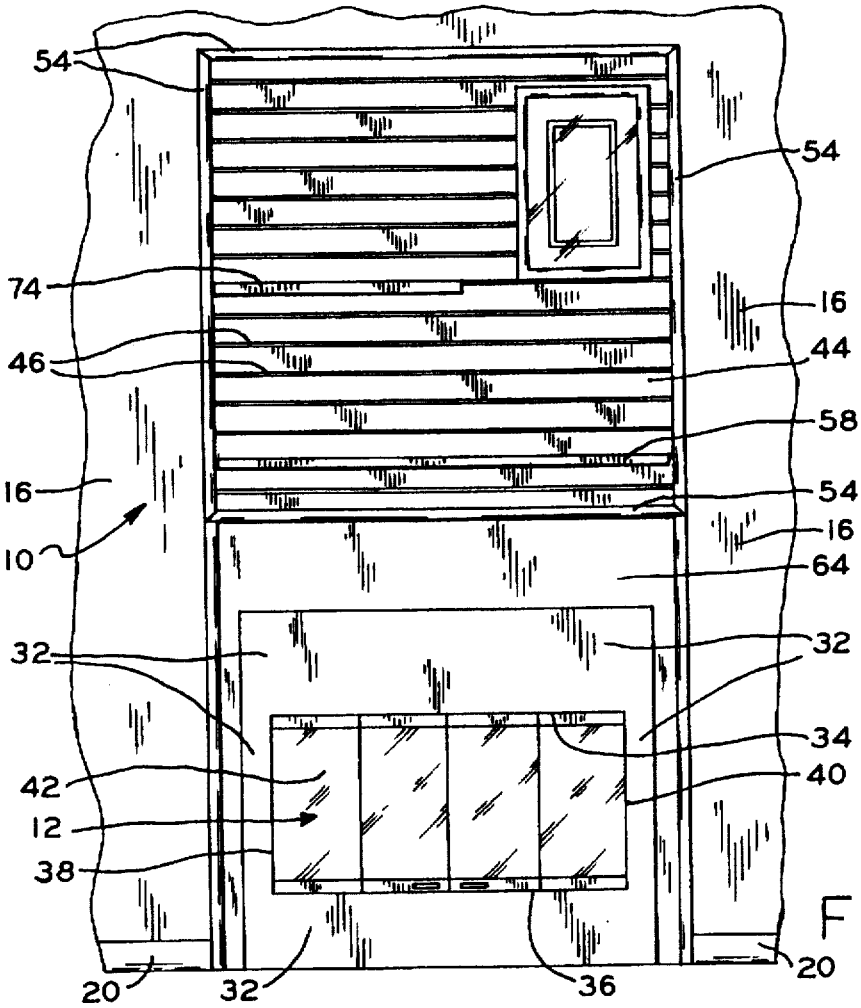
FIG. 5 is a front elevation view of a second embodiment of a fireplace shelf and mantel support system constructed in accordance with the present invention; and, FIG. 6 is an enlarged cross-sectional partial view of the fireplace shelf and mantel support system shown in FIG. 1 taken along lines 2—2.

In the second embodiment shown in FIG. 5, the left and right slotwall panels 48 and 58 are eliminated and the upper slotwall panel 44 is increased in size for providing a substantially greater number of bracket support slots 46. Similar to the embodiment shown in FIG. 1, edge trim 54 is provided around the perimeter edge of the slotwall panel 44. The mantel or mantel shelf 58 is not provided with an apron. However, the support brackets (not shown) are made with legs 64 and support arms 68 which are smaller and which therefore are not apparently visible as shown and indicated in FIG. 5. The support bracket of shelf 74, similar to those used with the mantel therebelow, are also made of generally smaller legs 64 and arms 68 thereby not being readily visible as shown in FIG. 5.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A fireplace shelf and mantel support system comprising:

a fireplace opening extending through a wall;

a slotwall panel having a plurality of bracket support slots, said slotwall panel attached to said wall adjacent said fireplace opening; and, a mantel supported on said slotwall panel with a support bracket partially extending into one of said bracket support slots and away from said slotwall panel.

2. The fireplace shelf and mantel support system of claim 1, further comprising a shelf supported on said slotwall panel with a second support bracket partially extending into one of said bracket support slots and away from said slotwall panel.

3. The fireplace shelf and mantel support system of claim 2, wherein said fireplace opening includes vertical peripheral edges and an upper horizontal peripheral edge, wherein said slotwall panel is located above said upper horizontal peripheral edge.

4. The fireplace shelf and mantel support system of claim 3, further comprising a second slotwall panel having a plurality of bracket support slots, said second slotwall panel attached to said wall adjacent to and to a side of one of said vertical peripheral edges.

5. The fireplace shelf and mantel support system of claim 4, further comprising a second shelf supported on said second slotwall panel with a second support bracket partially extending into one of said bracket support slots of said second slotwall panel and away from said second slotwall panel.

6. The fireplace shelf and mantel support system of claim 3, wherein said bracket support slots are generally T-shaped and wherein said support brackets each include a leg having an inturned hook portion received in one of said T-shaped bracket support slots and a support arm affixed to and extending away from said leg.

7. The fireplace shelf and mantel support system of claim 3, further comprising edge trim extending along a perimeter edge of said slotwall panel.

8. The fireplace shelf and mantel support system of claim 2, wherein said bracket support slots are generally T-shaped and wherein said support brackets each include a leg having an inturned hook portion received in one of said T-shaped bracket support slots and a support arm affixed to and extending away from said leg.

9. The fireplace shelf and mantel support system of claim 2, further comprising edge trim extending along a perimeter edge of said slotwall panel.

10. The fireplace shelf and mantel support system of claim 1, wherein said fireplace opening includes vertical peripheral edges and an upper horizontal peripheral edge, wherein said slotwall panel is located above said upper horizontal peripheral edge.

11. The fireplace shelf and mantel support system of claim 10, further comprising a second slotwall panel having a plurality of bracket support slots, said second slotwall panel attached to said wall adjacent to and to a side of one of said vertical peripheral edges.

12. The fireplace shelf and mantel support system of claim 11, further comprising a second shelf supported on said second slotwall panel with a second support bracket partially extending into one of said bracket support slots of said second slotwall panel and away from said second slotwall panel.

13. The fireplace shelf and mantel support system of claim 12, wherein said bracket support slots are generally T-shaped and wherein said support brackets each include a leg having an inturned hook portion received in one of said T-shaped bracket support slots and a support arm affixed to and extending away from said leg.

14. The fireplace shelf and mantel support system of claim 12, further comprising edge trim extending along a perimeter edge of said slotwall panel.

15. The fireplace shelf and mantel support system of claim 1, wherein said bracket support slots are generally T-shaped.

16. The fireplace shelf and mantel support system of claim 15, wherein said support bracket includes a leg having an inturned hook portion partially received in one of said T-shaped bracket support slots and a support arm affixed to and extending away from said leg.

17. The fireplace shelf and mantel support system of claim 1, further comprising edge trim extending along a perimeter edge of said slotwall panel.

18. The fireplace shelf and mantel support system of claim 17, wherein said edge trim is L-shaped in cross section.

19. The fireplace shelf and mantel support system of claim 1, wherein said wall includes a drywall layer and said slotwall panel is attached to said wall over said drywall layer.

20. The fireplace shelf and mantel support system of claim 19, further comprising a fire resistant layer affixed to said drywall layer between said fireplace opening and said slotwall panel.

* * * * *